US007922535B1

(12) United States Patent
Jiang et al.

(10) Patent No.: US 7,922,535 B1
(45) Date of Patent: Apr. 12, 2011

(54) ELECTRICAL CONNECTOR

(75) Inventors: Hong-Liang Jiang, Taipei (TW); Wei-Hong Liao, Taipei (TW); Ming-Chiang Chen, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/940,315

(22) Filed: Nov. 5, 2010

(51) Int. Cl.
*H01R 13/648* (2006.01)

(52) U.S. Cl. ..... 439/607.35; 439/271

(58) Field of Classification Search ..... 439/607.35, 439/607.13, 607.27, 271
See application file for complete search history.

(56) References Cited

U.S. PATENT DOCUMENTS 6,183,275 B1 * 2/2001 Okura et al. ..... 439/271
6,540,568 B2 * 4/2003 Miyazaki ..... 439/607.35
7,086,901 B2 * 8/2006 Zhang ..... 439/607.56
7,238,050 B2 * 7/2007 Sakakura et al. ..... 439/607.52
7,481,664 B1 * 1/2009 Knoll et al. ..... 439/359

* cited by examiner

*Primary Examiner* — Briggitte R Hammond
(74) *Attorney, Agent, or Firm* — WPAT, P.C.; Anthony King

(57) ABSTRACT

An electrical connector includes an inner shielding shell, an insulating housing, a plurality of terminals and an outer shielding shell. The inner shielding shell defines an accommodating chamber therein. The insulating housing has a base body engaged with a rear of the accommodating chamber and a tongue portion extended forward from the base portion to stretch into a front of the accommodating chamber. A ring-shaped cavity is opened in a periphery of the base body for receiving a waterproof washer therein. An outer periphery of the waterproof washer abuts against insides of the inner shielding shell. The terminals are disposed in the insulating housing. The outer shielding shell surrounds the inner shielding shell. The outer shielding shell has at least one soldering arm soldered to a printed circuit board for achieving a ground function of the inner shielding shell through the outer shielding shell.

9 Claims, 4 Drawing Sheets

ELECTRICAL CONNECTOR

BACKGROUND OF THE INVENTION

1. Field of the Invention

The present invention relates to an electrical connector, and more particularly to an electrical connector having a waterproof structure.

2. The Related Art

Referring to FIG. 5, a traditional electrical connector 200 includes an insulating housing 10, a plurality of terminals 20 received in the insulating housing 10 and a shielding shell 30. The shielding shell 30 is of a hollow shape with an inserting space 301 formed therein for receiving the insulating housing 10. Two sides of the shielding shell 30 respectively define a fixing opening 302 for engaging with a hook of a mated connector (not shown), so that the electrical connector 200 can be engaged firmly with the mated connector (not shown).

However, a gap is formed between the shielding shell 30 and the insulating housing 10, and the electrical connector 200 has no waterproof structure, the moisture can enter the electrical connector 200 from the gap and the two fixing openings 302 of the shielding shell 30 to cause a phenomenon of short circuit. As a result, it's apt to generate a signal interruption to affect transmission quality, and lead to accidents of current leakage and electric shock.

SUMMARY OF THE INVENTION

An object of the present invention is to provide an electrical connector for being mounted to a printed circuit board. The electrical connector includes an inner shielding shell, an insulating housing, a plurality of terminals and an outer shielding shell. The inner shielding shell is looped from a metal plate to define an accommodating chamber therein. The insulating housing has a base body engaged with a rear of the accommodating chamber of the inner shielding shell and a tongue portion extended forward from the base portion to stretch into a front of the accommodating chamber. A ring-shaped cavity is opened in a periphery of the base body and perpendicular to the extending direction of the tongue portion for receiving a waterproof washer therein. An outer periphery of the waterproof washer abuts against insides of the inner shielding shell to seal up a chink between the base body and the inner shielding shell. The terminals are disposed in the insulating housing. The outer shielding shell surrounds the inner shielding shell and electrically connects with the inner shielding shell. The outer shielding shell has at least one soldering arm soldered to the printed circuit board for achieving a ground function of the inner shielding shell through the outer shielding shell.

As described above, the periphery of the waterproof washer abuts against the insides of the inner shielding shell to seal up the chink between the base body and the inner shielding shell. A waterproof ring is bound around the inner shielding shell and abuts against front edges of the lower shell and the upper shell for blocking the moisture from entering between the outer shielding shell (not labeled) and the inner shielding shell along a front of the electrical connector. Furthermore, the inner shielding shell has two hollow receiving hats for avoiding the moisture accumulating in the accommodating chamber.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
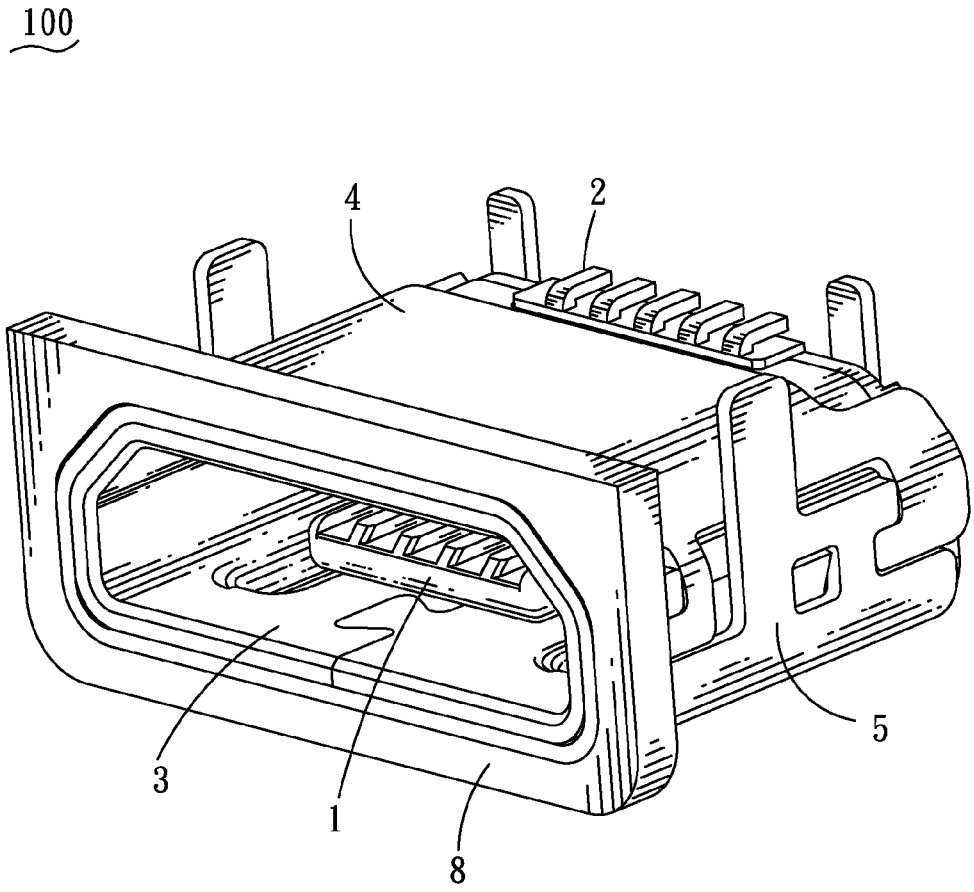
FIG. 1 is a perspective view of an electrical connector according to the present invention.
Figure 2:
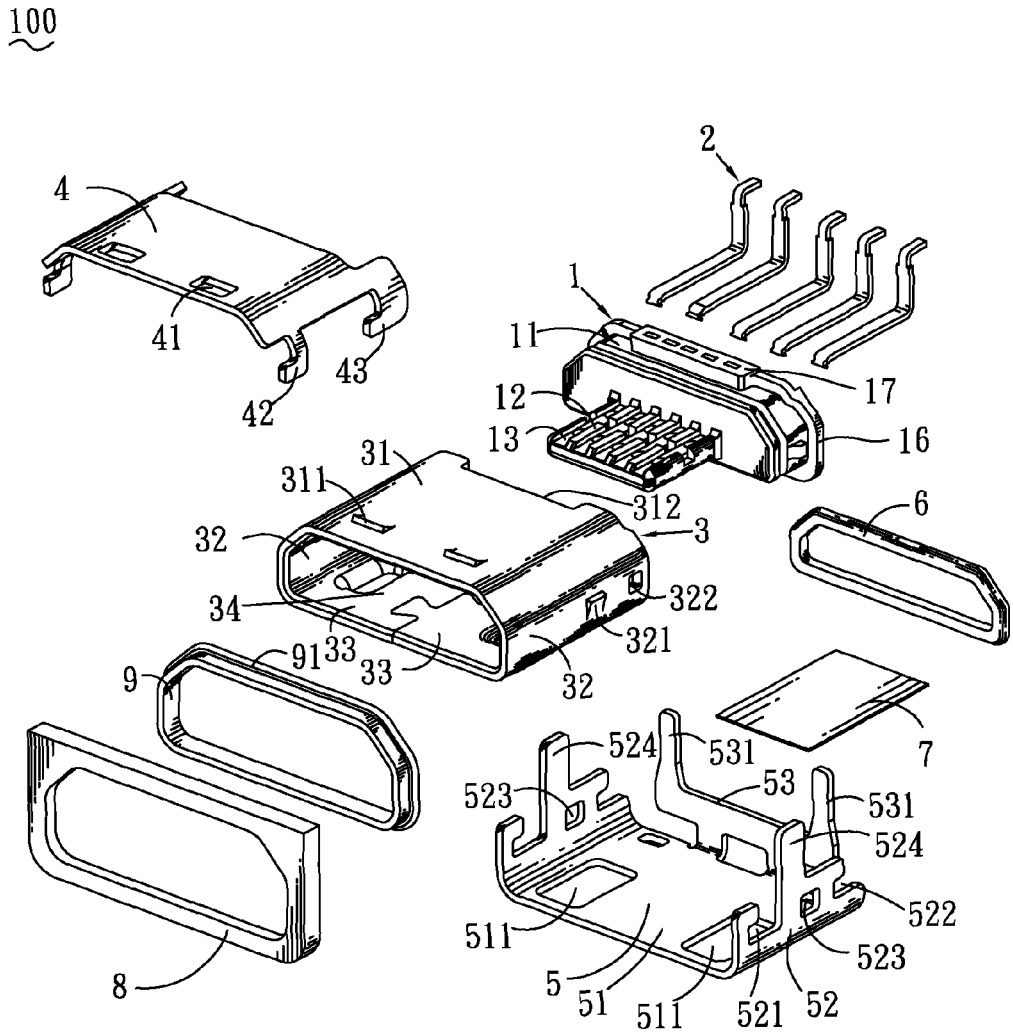
FIG. 2 is an exploded view of the electrical connector of FIG. 1.

Referring to FIG. 1 and FIG. 2, an electrical connector 100 according to the present invention is adapted for being mounted to a printed circuit board (not shown). The electrical connector 100 includes an insulating housing 1, a plurality of terminals 2 molded in the insulating housing 1, an inner shielding shell 3, an outer shielding shell (not labeled), a waterproof washer 6, a gasket 7, a retaining ring 8, and a waterproof ring 9.

Figure 3:
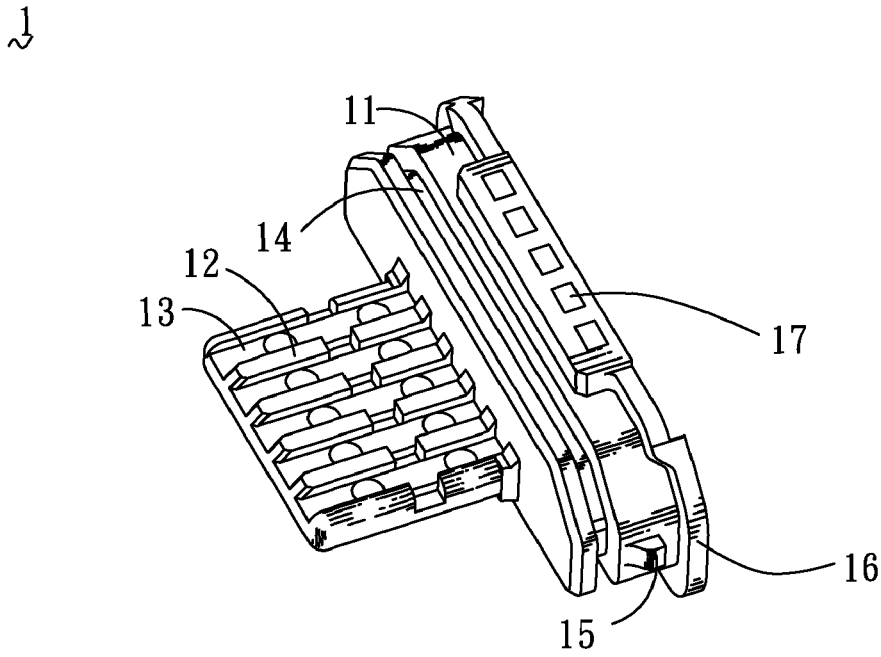
FIG. 3 is a perspective view of an insulating housing of the electrical connector of FIG. 1.

Referring to FIG. 2 and FIG. 3, the insulating housing 1 has a base body 11 of a substantially rectangular shape and a tongue portion 12 protruded forward from a front of the base body 11. A periphery of the base body 11 is concaved inward to form a ring-shaped cavity 14 adjacent to the front thereof and perpendicular to the extending direction of the tongue portion 12. Two opposite sides of the base body 11 respectively protrude outward to form a locking block 15. A ring-shaped blocking wall 16 transversely encircles a rear end of the base body 11 of the insulating housing 1 and is apart from the cavity 14. A middle of a top of the rear end of the base body 11 protrudes upward to form a wedging block 17 located between the blocking wall 16 and the cavity 14. A plurality of terminal grooves 13 are opened in a top of the tongue portion 12, and each of the terminal grooves 13 passes through the wedging block 17 of the base body 11 and a front end of the tongue portion 12.

Figure 4:
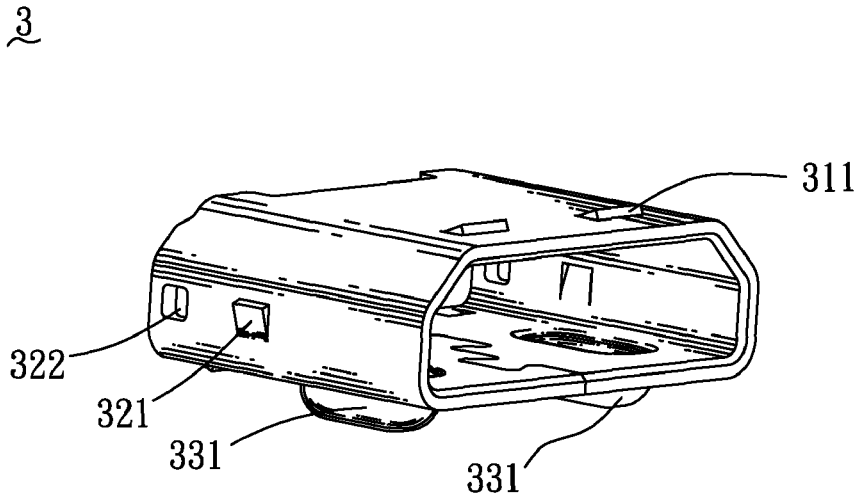
FIG. 4 is a perspective view of a shielding shell of the electrical connector of FIG. 1.
Figure 5:
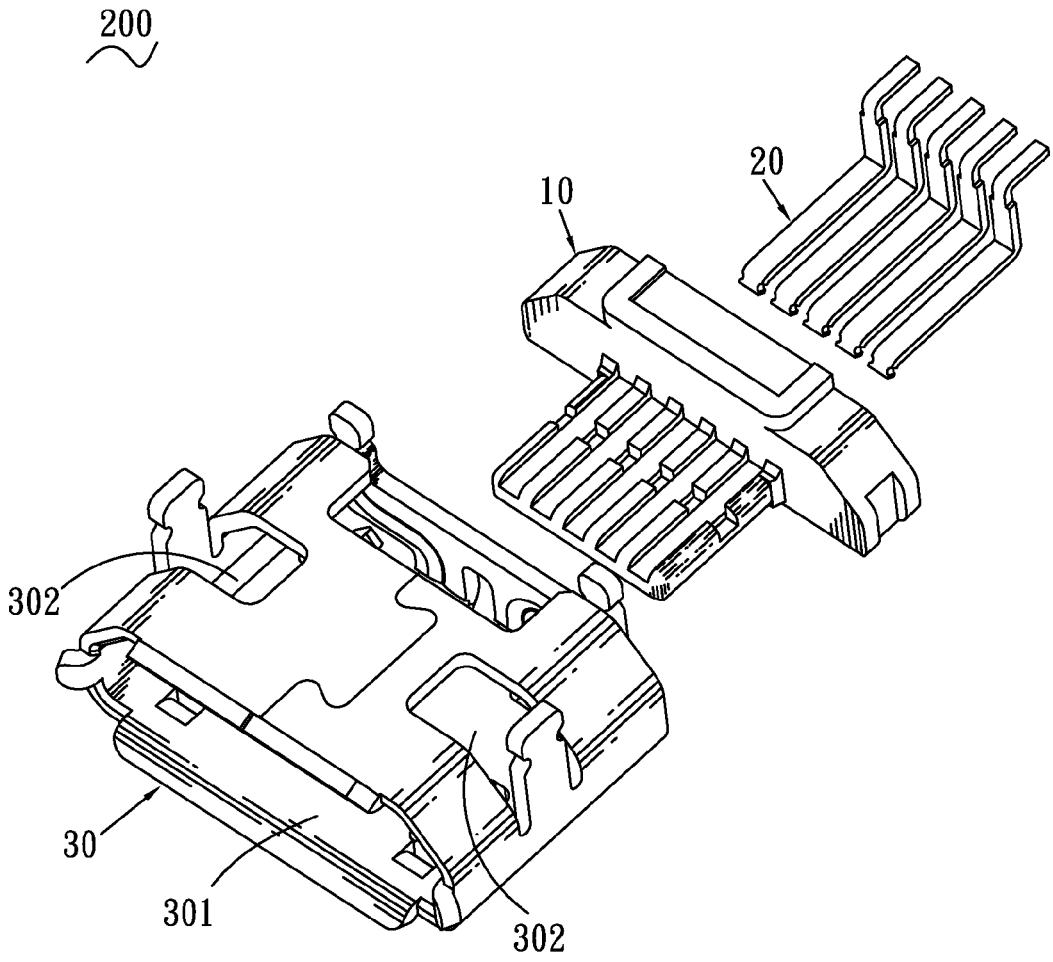
FIG. 5 (Prior Art)
FIG. 5 is an exploded view of a traditional electrical connector of FIG. 1.

Referring to FIG. 2 and FIG. 4, the inner shielding shell 3 is made of metal plate, and is of a rectangular hollow shape with an accommodating chamber 34 formed therein. The inner shielding shell 3 has a top plate 31. Two side plates 32 are extended downward from two opposite side edges of the top plate 31. Two bottom edges of the two side plates 32 extend towards each other to form a pair of bottom plates 33 engaged with each other. Two portions of the top plate 31 are punched upward to form two fastening blocks 311 spaced from each other. A rear edge of the top plate 31 is concaved inward to form a wedging gap 312. Each side plate 32 is punched outward to form a buckling block 321, and defines a locking hole 322 in rear of the buckling block 321. Each bottom plate 33 is punched opposite to the accommodating chamber 34 to form a hollow receiving hat 331 for avoiding the moisture accumulating in the accommodating chamber 34.

Referring to FIG. 2, the outer shielding shell includes an upper shell 4 and a lower shell 5 mated with each other.

Referring to FIG. 2, two portions of the upper shell 4 defines two fastening holes 41 spaced from each other. Each side edge of the upper shell 4 is bent downward and then is provided with an L-shaped first fixing arm 42 and an L-shaped second fixing arm 43 looked through a lateral view. The first fixing arm 42 is adjacent to a front of the side of the upper shell 4, and the second fixing arm 43 is at a rear end thereof, respectively.

Referring to FIG. 2, the lower shell 5 has a rectangular base plate 51. Two opposite side edges of the base plate 51 extend upward to from two connecting plates 52 to engage with the upper shell 4. A rear edge of the base plate 51 extends upward to form a preventing frame 53. A front of the base plate 51 defines two openings 511 spaced from each other. A front of each of the connecting plates 52 defines an L-shaped first fixing groove 521. A rear end of each of the connecting plates 52 defines an L-shaped second fixing groove 522. A substantial middle of each connecting plate 52 defines a buckling hole 523. A middle of a top edge of each connecting plate 52 extends upward to form a first soldering arm 524. Two ends of a top edge of the preventing frame 53 extend upward to form two second soldering arms 531, respectively.

Referring to FIG. 2, a rear edge of a periphery of the waterproof ring 9 protrudes outward to form a ring-shaped blocking rib 91.

Referring to FIGS. 1-4, when the electrical connector 100 is assembled, the waterproof washer 6 is clipped in the cavity 14 of the insulating housing 1 and a periphery of the waterproof washer 6 abuts against insides of the inner shielding shell 3 to seal up a chink between the base body 11 and the inner shielding shell 3. The insulating housing 1 is inserted into the accommodating chamber 34 of the inner shielding shell 3 with a base body 11 being engaged with a rear of the accommodating chamber 34 of the inner shielding shell 3 and a tongue portion stretching into a front of the accommodating chamber 34. The wedging block 17 is received in the wedging gap 312 with other rear edges of the inner shielding shell 3 abutting against a front side of the blocking wall 16 for avoiding the moisture entering the accommodating chamber 34 along a rear of the inner shielding shell 3.

Referring to FIGS. 1-4, the outer shielding shell surrounds the inner shielding shell 3 and electrically connects with the inner shielding shell 3. The lower shell 5 is assembled to a bottom of the inner shielding shell 3. The gasket 7 is clipped between the bottom plates 33 of the inner shielding shell 3 and the base plate 51 of the lower shell 5 to further seal up a joint of the bottom plates 33 and prevent the moisture from entering the accommodating chamber 34 from the joint of the bottom plates 33. The hollow receiving hats 331 are received in the openings 511 of the lower shell 5. The buckling blocks 321 of the inner shielding shell 3 is buckled in the buckling holes 523 of the lower shell 5. The upper shell 4 is assembled to the top of the inner shielding shell 3. The fastening blocks 311 of the inner shielding shell 3 are fastened in the fastening holes 41 of the upper shell 4. The first fixing arms 42 and the second fixing arms 43 of the upper shell 4 are fastened in the first fixing grooves 521 and the second fixing grooves 522, respectively. The preventing frame 53 is located against a rear surface of the base body 11 of the insulating housing 1.

Referring to FIGS. 1-4 again, the waterproof ring 9 is bound around a front end of the inner shielding shell 3 with a rear side of the blocking rib 91 abutting against front edges of the lower shell 5 and the upper shell 4 for blocking the moisture from entering between the outer shielding shell and the inner shielding shell 3 along a front of the electrical connector 100. The retaining ring 8 is bound around the waterproof ring 9 with a rear side thereof abutting against the blocking rib 91. The first soldering arms 524 and the second soldering arms 531 are soldered to the printed circuit board for achieving a ground function of the inner shielding shell 3 through the outer shielding shell.

As described above, the periphery of the waterproof washer 6 abuts against the insides of the inner shielding shell 3 to seal up the chink between the base body 11 and the inner shielding shell 3. The wedging block 17 is received in the wedging gap 312 with other rear edges of the inner shielding shell 3 abutting against the front side of the blocking wall 16 for avoiding the moisture entering the accommodating chamber 34 along the rear of the inner shielding shell 3. The waterproof ring 9 is bound around the inner shielding shell 3 and abuts against the front edges of the lower shell 5 and the upper shell 4 for blocking the moisture from entering between the outer shielding shell and the inner shielding shell 3 along the front of the electrical connector 100. Furthermore, the inner shielding shell 3 has two hollow receiving hats 331 for avoiding the moisture accumulating in the accommodating chamber 34.

What is claimed is:

1. An electrical connector for being mounted to a printed circuit board, comprising:

an inner shielding shell looped from a metal plate to define an accommodating chamber therein;

an insulating housing having a base body engaged with a rear of the accommodating chamber of the inner shielding shell and a tongue portion extended forward from the base portion to stretch into a front of the accommodating chamber, a ring-shaped cavity being opened in a periphery of the base body and perpendicular to the extending direction of the tongue portion for receiving a waterproof washer therein, wherein an outer periphery of the waterproof washer abuts against insides of the inner shielding shell to seal up a chink between the base body and the inner shielding shell;

a plurality of terminals disposed in the insulating housing; and an outer shielding shell surrounding the inner shielding shell and electrically connecting with the inner shielding shell, the outer shielding shell having at least one soldering arm soldered to the printed circuit board for achieving a ground function of the inner shielding shell through the outer shielding shell.

2. The electrical connector as claimed in claim 1, wherein the inner shielding shell has a top plate, two side plates extending downward from two opposite side edges of the top plate, and two bottom plates extending towards each other from two bottom edges of the side plates, the bottom plates are engaged with each other and punched oppositely to the accommodating chamber to form at least one hollow receiving hat for avoiding the moisture accumulating in the accommodating chamber, the outer shielding shell has a base plate of which a portion corresponding to the receiving hat defines an opening for receiving the receiving hat therein.

3. The electrical connector as claimed in claim 2, further comprising a gasket, the gasket being clipped between the bottom plates of the inner shielding shell and the base plate of the outer shielding shell to further seal up a joint of the bottom plates and prevent the moisture from entering the accommodating chamber from the joint of the bottom plates.

4. The electrical connector as claimed in claim 1, wherein a ring-shaped blocking wall transversely encircles a rear end of the base body of the insulating housing and is apart from the cavity, a top of the base body protrudes upward to form a wedging block located between the blocking wall and the cavity, the inner shielding shell has a top plate of which a rear edge defines a wedging gap for buckling the wedging block therein, other rear edges of the inner shielding shell abut against the blocking wall.

5. The electrical connector as claimed in claim 1, further comprising a waterproof ring which is bound around a front end of the inner shielding shell, a rear edge of a periphery of the waterproof ring protruding outward to form a ring-shaped blocking rib abutting against front edges of the outer shielding shell for blocking the moisture from entering between the outer shielding shell and the inner shielding shell along a front of the electrical connector.

6. The electrical connector as claimed in claim 5, further comprising a retaining ring which is bound around the waterproof ring and abuts against the blocking rib.

7. The electrical connector as claimed in claim 1, wherein the outer shielding shell includes an upper shell and a lower shell mated with each other, the lower shell has a base plate and two connecting plates extending upward from two opposite side edges of the base plate to engage with the upper shell, the soldering arm is formed by extending upward from a portion of a top edge of each connecting plate.

8. The electrical connector as claimed in claim 7, wherein each side edge of the upper shell is bent towards the corresponding connecting plate of the lower shell and then is provided with two L-shaped fixing arms, the connecting plate of the lower shell accordingly defines two fixing grooves for fastening the corresponding fixing arms therein.

9. The electrical connector as claimed in claim 7, wherein a rear edge of the base plate extends upward to form a preventing frame located against a rear surface of the base body of the insulating housing, the soldering arm is further formed by extending upward from a top edge of the preventing frame.

* * * * *